United States Patent [19]

Mahoney

[11] 4,377,283

[45] Mar. 22, 1983

[54] BASKETBALL BACKBOARD REINFORCING ASSEMBLY

[76] Inventor: Kenneth J. Mahoney, Dorrance, Kans. 67634

[21] Appl. No.: 246,934

[22] Filed: Mar. 24, 1981

[51] Int. Cl.[3] ..... A63B 63/08

[52] U.S. Cl. ..... 273/1.5 R

[58] Field of Search ..... 273/1.5 R, 1.5 A; 248/208, 236; 211/87

[56] References Cited

U.S. PATENT DOCUMENTS

| | | | |
|---|---|---|---|
| 2,553,105 | 5/1951 | Morey | 273/1.5 R |
| 3,025,058 | 3/1962 | Brumfield | 273/1.5 R |
| 4,111,420 | 9/1978 | Tyner | 273/1.5 R |
| 4,320,896 | 3/1982 | Engle et al. | 273/1.5 R |

*Primary Examiner*—Paul E. Shapiro

*Attorney, Agent, or Firm*—Phillip A. Rein

[57] ABSTRACT

This invention is a basketball backboard reinforcing assembly that can be attached to new or existing basketball backboard members to strengthen same and prevent breaking thereof when a basketball player grasps a basketball goal assembly attached thereto. More particularly, the basketball backboard reinforcing assembly includes a transparent support plate mounted against a back side of the backboard member; a front and a rear connector plate secured together by a connector assembly to clamp the support plate and the backboard member therebetween; and a base support assembly operable to secure together the lower edges of the support plate and the backboard member. The support plate acts to transmit forces and stress applied to the basketball goal assembly to a large area to prevent breaking of the backboard member. The base support assembly is important to prevent relative flexing movement of the interconnected support plate and backboard member. The basketball backboard reinforcing assembly can be attached to old and fatigued backboard member to revitalize same and add years of new useful life to the same.

12 Claims, 3 Drawing Figures

FIG. 1
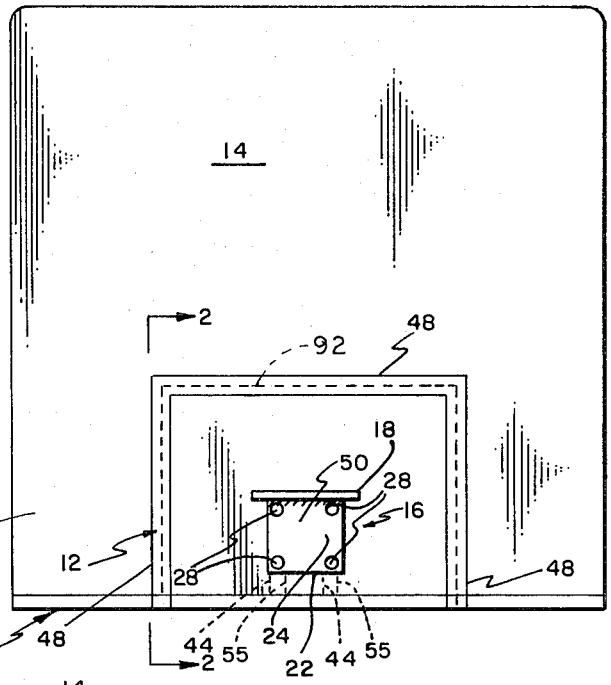
FIG. 3
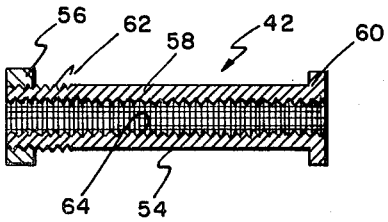
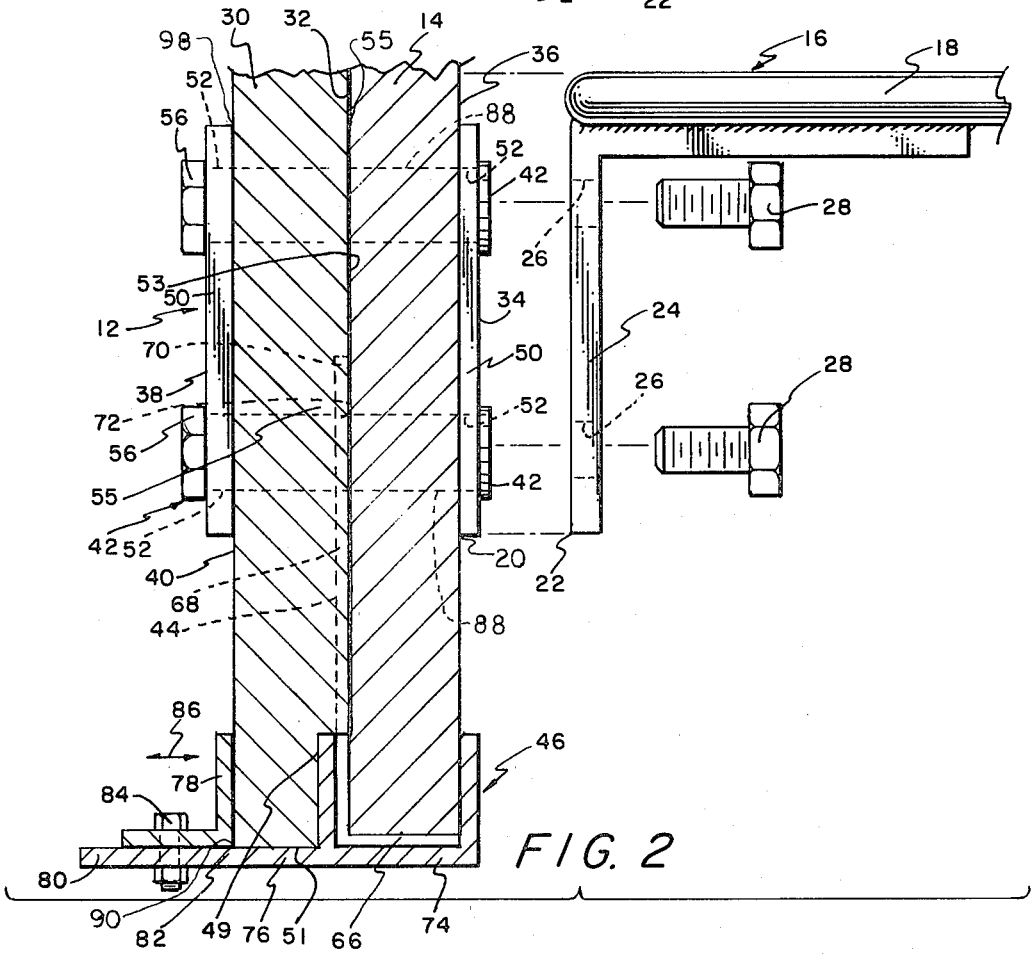
FIG. 2

BASKETBALL BACKBOARD REINFORCING ASSEMBLY

PRIOR ART

A search of the prior art was not conducted as the inventor herein is very knowledgeable of devices being developed to prevent damage to basketball backboard structures caused by basketball players grabbing a basketball rim during a basketball "dunking" operation. In fact, the inventor herein has been active in the development of a break-away basketball goal assembly to prevent breakage of backboard members.

However, is has been determined that further steps should be taken to strengthen new and old basketball backboard members to add a greater safety factor to prevent damage thereto.

SPECIAL EMBODIMENT OF THE INVENTION

In one preferred embodiment of the invention, a basketball backboard reinforcing assembly is connectable to a conventional basketball backboard member to receive and distribute forces applied to a basketball goal assembly connected thereto and prevent damage to the subject backboard member. The basketball backboard reinforcing assembly includes a support plate constructed of a rigid, transparent material; a connector assembly used to secure a front connector plate to a rear connector plate while clamping the support plate and the backboard member therebetween; a base support assembly connected to lower adjacent edges of the support plate and the backboard member to restrict relative movement thereof; and a pair of retainer members connected to the connector assembly and the base support assembly. The support plate covers a large area relative to an anchor plate of the basketball goal assembly to distribute the forces against the goal assembly over subject large area. The base assembly prevents relative movement of the support plate and the backboard member to prevent localized stress points. The retainer members are added safety features to prevent falling of the basketball goal assembly in case the backboard member does break and shatter. However, the basketball backboard reinforcing assembly of this invention would make the retainer member unnecessary but, as stated, are present herein as an added safety feature.

OBJECTS OF THE INVENTION

One object of this invention is to provide a basketball backboard reinforcing assembly that is readily attached to new or existing basketball backboard members to add rigidity and prevent damage thereto during basketball play.

Another object of this invention is to provide a basketball backboard reinforcing assembly attachable to a backboard member that does not distract from a basketball player's normal vision of the basketball goal assembly.

Still, one other object of this invention is to provide a basketball backboard reinforcing assembly connectable to a backboard member and operable to take forces applied to an attached basketball goal assembly and distribute over a large area to minimize the chances of damage to the backboard member.

One other object of this invention is to provide a basketball backboard reinforcing assembly that is easy to install on existing basketball backboard member; hidden in appearance so as to not distract from normal basketball play; and sturdy in construction.

Various other objects, advantages, and features of the invention will become apparent to those skilled in the art from the following discussion, taken in conjunction with the accompanying drawings, in which:

FIGURES OF THE INVENTION

FIG. 1 is a front elevational view of a basketball backboard and goal assembly having a basketball backboard reinforcing assembly of this invention attached thereto;

FIG. 2 is an enlarged fragmentary sectional view taken along line 2—2 in FIG. 1; and FIG. 3 is a sectional view of a connector assembly of the basketball backboard reinforcing assembly of this invention.

The following is a discussion and description of preferred specific embodiments of the basketball backboard reinforcing assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a basketball backboard reinforcing assembly of this invention, indicated generally at 12, is shown as secured to a basketball backboard member 14 for the main purpose of absorbing and distributing forces applied thereto through a basketball goal assembly 16. The basketball backboard member 14 can be of a different shape but is normally constructed of a thick, clear plexiglass material when used in college and professional basketball play.

A problem arises in the use of the plexiglass material as it is subject to breaking and shattering when an excessive load is applied to the basketball goal assembly 16 especially when a basketball player "dunks" a basketball through a basketball rim section 18. The problem is the player gets hooked or grabs the rim section 18 and excessive pressure is transmitted to a lower edge 22 of a connector or anchor plate 24 to which the rim section 18 is secured. The basketball backboard reinforcing assembly 12 of this invention operates to eliminate the excessive pressure being applied at the edges 20, 22, and, thus, shattering of the backboard member 14.

The basketball goal assembly 16 includes the circular rim section 18 secured to the anchor plate 24 and having a basketball net (not shown) connected to the rim section 18 in a conventional manner. The anchor plate 24 is provided with four (4) spaced holes 26 therein to receive respective bolt members 28 therethrough for securing the anchor plate 24 to the basketball backboard reinforcing assembly 12 in a manner to be explained.

The basketball backboard reinforcing assembly 12 includes a heavy transparent support or back-up plate 30 secured against a back surface 32 of the backboard member 14; a front connector plate 34 secured against a front surface 36 of the backboard member 14; a rear conncetor plate 38 secured against an outer surface 40 of the support plate 30; a connector assembly 42 used to interconnect the front connector plate 34 and the rear connector plate 38 with the backboard member 14 and the support plate 30 sandwiched therebetween; a pair of retainer members 44 mounted between the support plate 30 and the backboard member 14; and a base support assembly 46 connected to lower edges of the support plate 30 and the backboard member 14.

As noted in FIG. 1, the front surface 36 of the backboard member 14 is formed with an orange boundary 48 which surrounds and high-lights the basketball goal assembly 16 to aid in directing a basketball through the circular rim section 18. The boundary 48 is normally 18" by 24" and the outer periphery of the support plate 30 is of a similar size so that the edges of the support plate 30 are hidden by the boundary 48.

The support plate 30 is formed with a notch section 49 in a lower edge portion 51 to receive a portion of the base support assembly 46 therein in a manner to become obvious. Also, a front surface 53 of the support plate 30 is formed with two identical, spaced cut-out sections 55 to receive respective ones of the retainer members 44 therein in a manner to be explained.

The support plate 30 is of a transparent, strong material such as plexiglass, Lexan, bullet-proof glass or other such materials. The backboard member 14 is normally ½ inch thick while the support plate is ¾ inch thick.

The front connector plate 34 includes a main body 50 of steel plate construction having four (4) spaced holes 52 therein. The front connector plate 34 is of a size similar to the anchor plate 24 whereby the holes 26 and 52 can be aligned during assembly.

The rear connector plate 38 is substantially identical to the front connector plate 34 also having the four (4) spaced holes 52 therein.

The connector assembly 42 includes four (4) connector lugs 54 with a nut member 56 mountable on each respective one of the connector lugs 54. As noted in FIG. 3, each connector lug 54 includes a main body 58 formed with a shoulder or ledge portion 60 at one end and external threads 62 at the opposite end. A hole is bored through a center of the main body 58 and internal threads 64 are formed therein to receive the bolt members 28 therein in a manner to be described.

The retainer members 44 are of generally L-shape having a short leg section 66 integral with a long leg section 68. A top portion 70 of the long leg section 68 is formed with a hole 72 therein to receive a connector lug 54 therethrough. The retainer members 44 act to prevent the basketball goal assembly 16 from falling and injuring a person in the area if for some reason the backboard member 14 should shatter.

The base support assembly 46 includes a forward U-shaped board section 74 to receive the backboard member 14 and a portion of the of the short leg section 66 therein; an intermediate L-shaped section 76 to receive a portion of the support plate 30 therein; and a support block member 78 secured to an extended section 80. It is seen that the extended section 80 is integral with a lower leg section 82 of the intermediate section 76.

The support block member 78 resembles a piece of angle iron of a length equal to the width of the support plate 30. The support block member 78 is secured as by a plurality of spaced nut and bolt members 84 to the extended section 80. The support block member 78 is adjustably movable as shown by an arrow 86 so as to firmly clamp the support plate 30 against the backboard member 14 and the intermediate section 76.

The U-shape board section 74 is extended about the periphery of the backboard member 14 to add rigidity whereas the intermediate section 76 and interconnected extended section 80 are connected to a lower edge of the support plate 30.

It is also noted that the backboard member 14 and the support plate 30 are formed with an aligned set of four holes 88 which, in turn, are aligned with the holes 26 and both sets of holes 52 for obvious assembly reasons.

USE AND OPERATION OF THE INVENTION

The backboard member 14 and the basketball goal assembly 16 are of a substantially conventional nature and the basketball backboard reinforcing assembly 12 of this invention is attached to add rigidity and strength thereto.

More particularly and as best shown in FIG. 2, the front connector plate 34 is placed against the front surface 36 of the backboard member 14 with the holes 88 and 52 aligned. The connector lugs are then inserted through the aligned holes 88, 52 with the shoulder portions 60 abutting an outer surface of the front connector plate 34. The retainer members 44 have their holes 72 placed about respective ones of lower ones of the connector lugs 54 as shown in FIG. 2. The short leg section 66 extends against and below a lower edge of the backboard member 14.

Next, the support plate 30 is placed against the back surface 32 of the backboard member 14 with the connector lugs 54 extended through respective holes 88. The nut members 56 are then loosely threaded on the respective external threads 62 of the connector lugs 54.

As an added feature to provide rigidity, the surfaces 32, 53 of the backboard member 14 and the support plate 30 are bonded together as be a solvent or an adhesive material indicated at 55. A plexiglass solvent may be used and will prevent any relative movement of the support plate 30 and the backboard member 14.

The base support assembly 46 is placed in the position of FIG. 2 with the board section 74 extended about the entire peripheral edge of the backboard member 14.

Next, the nut members 56 are tightened to firmly clamp the support plate 30 to the backboard member 14 and the support block member 78 is secured to the extended section 80 by the nut and bolt members 84. The support block member 78 acts to prevent outward movement of the support plate 30 at a corner 90 which would be the normal result on applying a downward force on the rim section 18 of the basketball goal assembly 16. This prevents an excessive force being applied at an upper, horizontal edge 92 of the support plate 30 when above downward force is applied.

Then, the holes 26 in the anchor plate 24 are aligned with thhe internal threads 64 in the respective connector lugs 54. The bolt members 28 are tightened into the threads 64 to clamp the anchor plate 24 against the front connector plate 34 to rigidly mount the basketball goal assembly 16.

It is seen that the retainer members 44 are connected by the long leg sections 68 to respective lower ones of the connector lugs 54 plus the short leg sections 66 are clamped between the board section 74 and the backboard member 14. As the board section 74 extends about the periphery of the backboard member 14, the retainer members 44 act as safety devices to hold the basketball goal assembly 16 to the board section 74 in case the backboard member 14 would happen to break.

However, with the basketball backboard reinforcing assembly 12 of this invention, it is felt that the retainer members 44 are not necessary but are added herein as an additional, inexpensive safety feature.

In normal mounting of the basketball goal assembly 16 to the backboard member 14, the stresses are applied at the lower edge 22 of the anchor plate 24 and an upper edge 98 of the rear connector plate 38 when a downward force from "dunking" the basketball occurs against the rim section 18. This causes substantial stress in a small area which causes the backboard member 14 to shatter which has been seen on national television.

With the use of the basketball backboard reinforcing assembly 12 of this invention, the forward stresses and forces at the upper edge 98 of the rear connector plate 38 are transferred into the support plate 30 and to a large area covered thereby. At the same time, the inward stresses at the lower edges 20, 22 are distributed through the backboard member 14 and the support plate 30. The support block member 78 does not allow the corner 90 to move so that the forces generated inwardly at the lower edge 22 are transmitted to the larger area defined by the support plate 30.

While the invention has been described in conjunction with preferred specific embodiments thereof, it will be understood that this description is intended to illustrate and not to limit the scope of this invention, which is defined by the following claims.

I claim:

1. A basketball goal and backboard assembly having a basketball backboard reinforcing assembly of this invention attached thereto, comprising:

(a) a backboard member;

(b) a basketball goal assembly having an anchor plate adapted to be connected to said backboard member;

(c) a support plate of a size greater than said anchor plate placed against one side of said backboard member to surround said anchor plate;

(d) a connector assembly to clamp said support plate against said backboard member;

(e) connector means to secure said anchor plate to said connector assembly;

(f) a connector plate secured against said support plate by said connector assembly; and whereby a downward force applied to said basketball goal assembly is transferred through said connector assembly and said connector plate to said support plate to minimize the chances of said backboard member breaking.

2. A basketball backboard reinforcing assembly as described in claim 1, including:

(a) a front connector plate secured against said backboard member;

(b) said connector plate being a rear connector plate secured against said support plate;

(c) said connector assembly connected to said front connector plate and said second connector plate with said backboard member and said support plate clamped therebetween.

3. A basketball backboard reinforcing assembly as described in claim 2, wherein:

(a) said connector assembly having connector lugs extended through said backboard member and said support plate and nut members secured to outer ends of said connector lugs.

4. A basketball backboard reinforcing assembly as described in claim 3, wherein:

(a) said connector lugs each having a central opening with internal threads therein; and (b) said connector means are bolt members mounted in said internal threads.

5. A basketball backboard reinforcing assembly as described in claim 1, including:

(a) a base support assembly secured to lower adjacent edges of said backboard member and said support plate to prevent lateral movement therebetween.

6. A basketball backboard reinforcing assembly as described in claim 5, wherein:

(a) said base support assembly having a board section to receive and hold said lower end of said backboard member therein and a support block member secured against a lower outside edge of said support plate to prevent movement whereof.

7. A basketball backboard reinforcing assembly as described in claim 6, including:

(a) said lower edge of said support plate having a notch section therein to receive a mid-portion of said base support assembly; and (b) said mid-portion acts as a stop member when said support block member is used to clamp said support plate to said backboard member.

8. A basketball backboard reinforcing assembly as described in claim 5, including:

(a) a retainer member is connected to said connector assembly and said base support assembly to prevent said basketball goal assembly from coming completely disengaged from said base support assembly.

9. A basketball backboard reinforcing assembly as described in claim 8, wherein:

(a) said retainer member is of L-shape having a leg portion connected to said connector assembly and another leg portion connected to said base support assembly.

10. A basketball backboard reinforcing assembly as described in claim 1, including:

(a) abutting surfaces of said backboard member and said support plate are secured to each other.

11. A basketball backboard reinforcing assembly as described in claim 10, wherein:

(a) said abutting surfaces are secured to each other by a bonding material.

12. A basketball backboard reinforcing assembly as described in claim 1, wherein;

(a) said connector assembly connected to said anchor plate, said connector plate, and said support plate;

whereby the downward force applied to said basketball goal assembly is transferred from said anchor plate to said connector assembly to said connector plate to said support plate to prevent breakage of said backboard member.

* * * * *